US005417633A

United States Patent [19]

Habing

[11] Patent Number: 5,417,633

[45] **Date of Patent: * May 23, 1995**

[54] MULTIPLE STATION EXERCISE APPARATUS

[75] Inventor: Theodore G. Habing, Long Beach, Calif.

[73] Assignee: Pacific Fitness Corporation, Cypress, Calif.

[ * ] Notice: The portion of the term of this patent subsequent to Feb. 4, 2009 has been disclaimed.

[21] Appl. No.: 173,921

[22] Filed: Dec. 27, 1993

Related U.S. Application Data

[63] Continuation of Ser. No. 966,894, Oct. 26, 1992, abandoned, which is a continuation of Ser. No. 828,000, Jan. 30, 1992, abandoned, which is a continuation of Ser. No. 658,077, Feb. 19, 1991, Pat. No. 5,085,430.

[51] Int. Cl.[6] ..... A63B 21/00

[52] U.S. Cl. ..... 482/97; 482/100; 482/102; 482/136; 482/137; 482/138

[58] Field of Search ..... 482/97–103, 482/130, 133, 135–138

[56] References Cited

U.S. PATENT DOCUMENTS

| | | | |
|---|---|---|---|
| Re. 31,170 | 3/1983 | Mazman . | |
| 4,349,192 | 9/1982 | Lambert, Jr. et al. | 482/101 |
| 4,407,495 | 10/1983 | Wilson | 482/97 |
| 4,422,636 | 12/1983 | de Angeli . | |
| 4,505,475 | 3/1985 | Olschansky et al. | 482/100 |
| 4,598,907 | 7/1986 | Ross | 482/97 |
| 4,603,855 | 8/1986 | Sebelle . | |
| 4,632,390 | 12/1986 | Richey . | |
| 4,678,185 | 7/1987 | Mahnke . | |
| 4,697,809 | 10/1987 | Rockwell | 482/102 |
| 4,744,559 | 5/1988 | Mahnke et al. | 482/99 |
| 4,809,972 | 3/1989 | Rasmussen et al. . | |
| 4,844,456 | 7/1989 | Habing et al. . | |
| 4,884,801 | 12/1989 | Schnell . | |
| 4,915,377 | 4/1990 | Malnke et al. . | |
| 4,930,768 | 6/1990 | Lapcevic | 482/100 |
| 4,949,958 | 8/1990 | Richey . | |
| 4,964,632 | 10/1990 | Rockwell . | |
| 4,982,955 | 1/1991 | Heasley | 482/100 |
| 4,999,670 | 1/1992 | Williamson | 482/97 |
| 5,085,430 | 2/1992 | Habing . | |

FOREIGN PATENT DOCUMENTS

| | | | |
|---|---|---|---|
| 3445104 | 6/1986 | Germany | 482/100 |
| 2167967 | 6/1986 | United Kingdom | 482/137 |
| 1200915 | 12/1985 | U.S.S.R. | 482/133 |

OTHER PUBLICATIONS

Amf American Lifestyler 9000 Brochure, 1983.

*Primary Examiner*—Richard J. Apley
*Assistant Examiner*—John Mulcahy
*Attorney, Agent, or Firm*—Blakely, Sokoloff, Taylor & Zafman

[57] ABSTRACT

An exercise apparatus includes a plurality of exercise stations, each of which exercises particular muscle groups of the body. Each exercise station is continuously coupled to a common stack of weights, a selectable number of which provide resistance to a user's operation of a selected exercise station. At least one of the exercise stations is coupled to the weight stack through a lever arm. A plurality of lever arms may be provided and mechanically interconnected so as to couple a plurality of exercise stations to the weight stack.

21 Claims, 4 Drawing Sheets

MULTIPLE STATION EXERCISE APPARATUS

This is a continuation of application Ser. No. 07/966,894 filed Oct. 26, 1992, now abandoned, which is a continuation of application Ser. No. 07/828,000 filed Jan. 30, 1992, now abandoned, which is a continuation of application Ser. No. 07/658,077 filed Feb. 19, 1991 now U.S. Pat. No. 5,085,430.

BACKGROUND OF THE INVENTION

1. Field of the Invention

This invention relates to exercise equipment, and particularly to a multiple station exercise apparatus in which various exercise stations share a common weight stack.

2. Background Art

A vast array of devices are available for exercising various parts of the human body. One class of such devices that is rapidly gaining in popularity is the multiple station exercise machine, wherein individual stations of the machine are designed to exercise particular muscle groups of the body. An exemplary device of this type is shown and described in U.S. Pat. No. 4,844,456 of which the inventor herein is a co-inventor. These devices generally have a single stack of weights that is shared by each of the individual exercise stations.

Many of the prior art multiple station exercise devices, including the one in the aforementioned U.S. Patent, require the operator to connect the weight stack to certain of the exercise stations prior to their use. This is usually accomplished by attaching a cable to a point on an operable member of the exercise station. The need to detach a cable from one exercise station and reattach it to another station is an inconvenience to the operator, and multistation exercise devices have been developed that eliminate this minor inconvenience. Such devices typically employ a complicated arrangement of cables and pulleys so that all of the exercise stations are continuously connected to the single weight stack. A device of this latter type is shown in U.S. Pat. No. 4,809,972.

SUMMARY OF THE INVENTION

The present invention provides an improved multiple station exercise apparatus wherein all stations are continuously coupled to a common weight stack. The various stations are arrayed about a frame of structural members. A wide variety of exercise stations may be provided. In the preferred embodiment to be subsequently described, these stations include a pectoral fly station, a high pulley station, a press arm station, a leg extension/curl station, a low pulley station and a vertical knee raise station, only the last of which is not coupled to the weight stack.

A significant feature of the present invention is employed in association with the pectoral fly station. In this aspect of the invention, operator movement of a pair of pectoral fly arms is resisted by the weight stack. The resistance of the weights is communicated, in part, by a lever arm arrangement that couples the pectoral fly arms to the main pulley and cable system of the apparatus. This arrangement significantly simplifies the cabling of the apparatus and reduces the number of pulleys and cables that would otherwise be required to accommodate the various exercise stations.

The aforementioned feature of the present invention can be readily expanded upon through an arrangement of multiple lever arms to provide a virtually unlimited number of pulling points or exercise stations in an apparatus having a single weight stack continuously coupled to all such stations.

DETAILED DESCRIPTION OF THE INVENTION

In the following description, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details. In other instances, detailed descriptions of well known mechanical elements are omitted so as to not obscure the description of the present invention with unnecessary detail.

Figure 1:
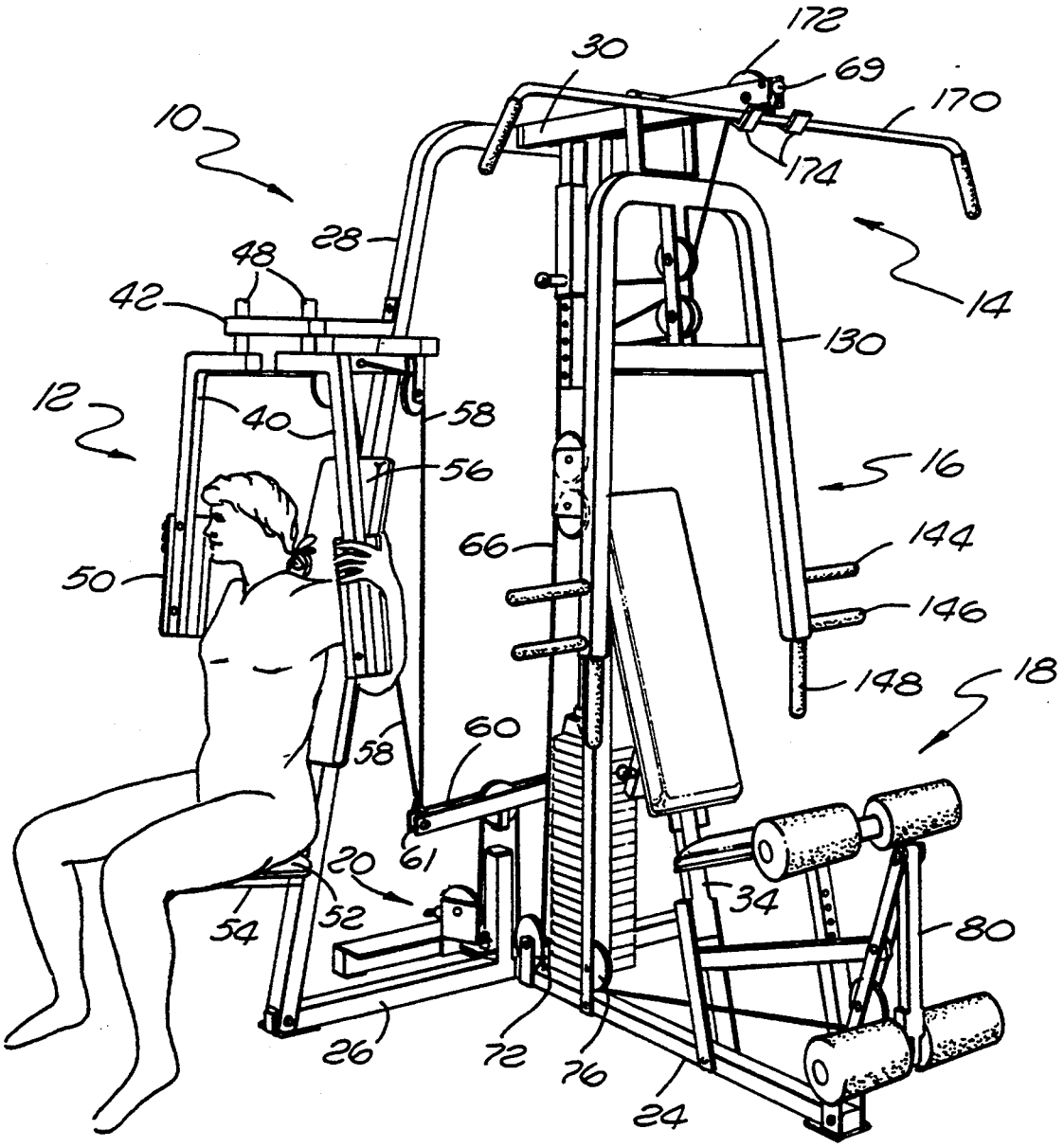
FIG. 1 is a perspective view of an exercise apparatus according to the present invention.
Figure 2:
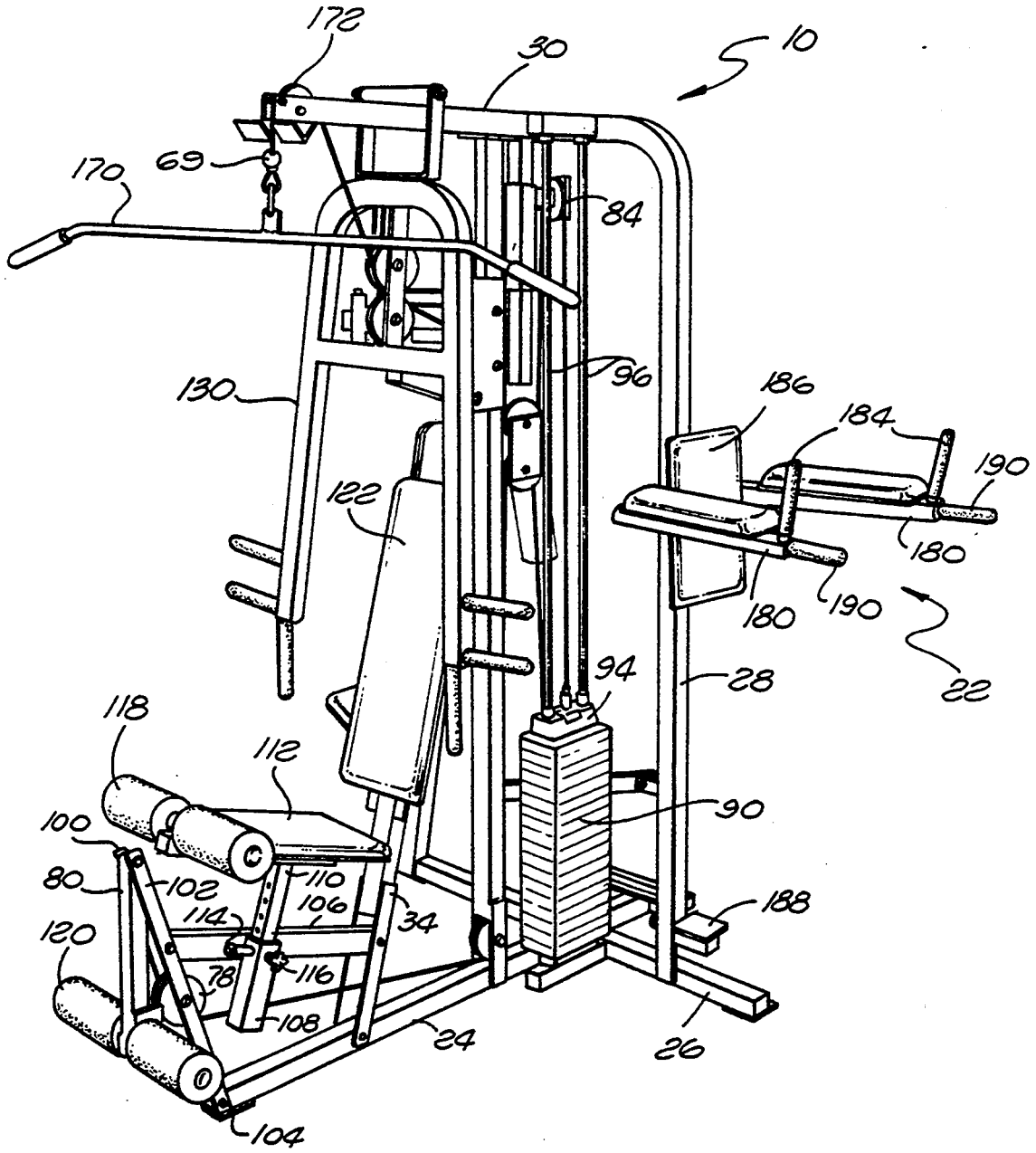
FIG. 2 is a perspective view of the apparatus shown in FIG. 1 viewed from a different direction.

Referring initially to FIGS. 1 and 2, an exercise apparatus 10 is illustrated. By way of preliminary explanation of apparatus 10, a plurality of exercise stations are provided at which specific exercises focused on particular muscle groups may be performed. Station 12 is generally referred to as the pectoral fly station at which exercises are performed for development of the pectoral and deltoid muscles. Station 14 is a high pulley station equipped with a lat bar primarily for development of the latissimus dorsi and tricep muscles. Station 16 is a press arm station for exercise of the chest and shoulder muscle groups. Station 18 is a leg extension/leg curl station for development of the muscle groups of the legs. Station 20 is a low pulley station for use in performing arm curl and leg kick-back exercises. Station 22 is a vertical knee raise station for development of the abdominal muscles. Each of these exercise stations will be more fully described below.

The various exercise stations of apparatus 10 are arrayed about a structure fabricated from a number of tubular members. Apparatus 10 is supported on the floor by a longitudinal base member 24 and lateral base member 26. Rear upright member 28 generally has the shape of an inverted "U" and is coupled to lateral base member 26 near opposing ends thereof. Top beam 30 extends forward from rear upright 28 and is supported by main upright 32. Front upright 34 is coupled at an angle between longitudinal base member 24 and main upright 32, thereby enhancing the longitudinal stability of the structure of apparatus 10.

The various structural members of apparatus 10 are conveniently fabricated from square or rectangular section steel tubing. For example, 2 inch×2 inch and 2 inch×3 inch, 11 gauge tubular steel is employed in the construction of a preferred embodiment of apparatus 10. However, other materials and other shapes for the structural members may be selected as a matter of design choice. The structural members of apparatus 10 are preferably secured to one another by mechanical fasteners, namely nuts and bolts, to facilitate disassembly of apparatus 10 for shipping and storage. However, the structural members of apparatus 10 may also be welded to one another or secured by other conventional fastening means.

In many respects, apparatus 10 is similar to the exercise apparatus disclosed in this inventor's Pat. No. 4,844,456, the disclosure of which is incorporated herein by reference. Numerous details regarding aspects of the structure and operation of apparatus 10 are fully described in the aforementioned patent and will not be described herein at length.

The individual exercise stations of apparatus 10 will now be discussed in greater detail. Referring primarily to FIG. 1, pectoral fly station 12 is supported by rear upright member 28. A pair of pectoral fly exercise arms 40 are pivotally suspended from support member 42 which is rigidly attached to rear upright member 28. Pectoral fly exercise arms 40 are essentially identical to the corresponding arms described in U.S. Pat. No. 4,844,456. In general terms, each of exercise arms 40 comprises a generally horizontal member 44 and a generally vertical member 46. Horizontal members 44 are pivotally connected at 48 to opposite ends of support member 42. Pads 50 are attached to the lower ends of vertical members 46 to provide a comfortable bearing surface for the operator. When using the pectoral fly exercise arms, the operator will generally be seated on seat cushion 52 which is supported by member 54 attached to rear upright member 28. Cushion 56 is also attached to rear upright member 28 to support the back of the operator while performing the pectoral fly exercise in the manner illustrated in FIG. 1.

Figure 4:
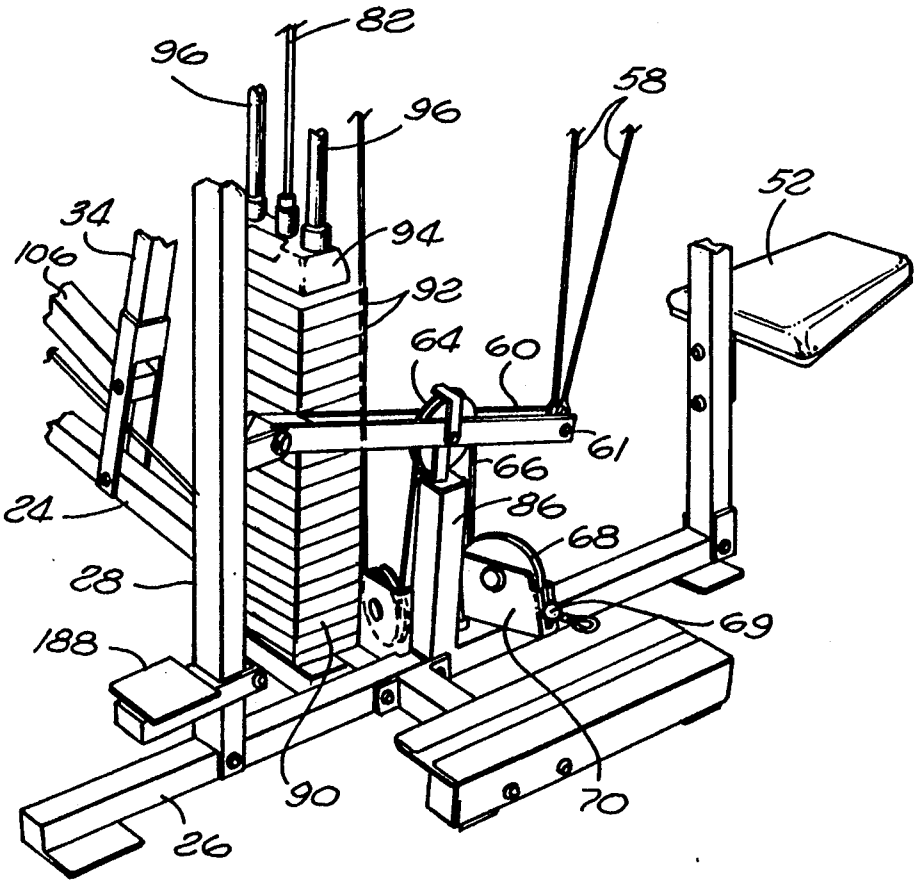
FIG. 4 is a detailed perspective view, primarily showing the lever arm arrangement of the present invention.

Each of pectoral fly exercise arms 40 has attached thereto a respective cable 58. Referring now also to FIG. 4, cables 58 are attached to outer end 61 of lever arm 60. Alternatively, another pulley similar to pulley 64 may be located at end 61 of lever arm 60. In this configuration, cables 58 would comprise a single continuous cable passing around the additional pulley at 61. This arrangement offers the added advantage of eliminating slack in cable 58 if the pectoral fly arms are not moved equally.

Lever arm 60 is pivotally connected at 62 to rear upright member 28. Pulley 64 is attached to lever arm 60 near the center thereof. Cable 66 passes over pulley 64 and is also guided around pulley 68 mounted with bracket 70. Cable stop 69 is secured to the end of cable 66 to prevent it from retracting through bracket 70. Bracket 70 is pivotally connected to lateral base member 26 and is operative as the low pulley station 20. Cable 66 also passes around pulley 72 which is secured to longitudinal base member 24. Passing around pulley 72, cable 66 continues upward to floating double pulley 74 and then continues downwardly, passing around pulley 76 which is also secured to longitudinal base member 24. Proceeding from pulley 76, cable 66 passes over pulley 78 and is attached to leg extension/curl arm 80.

Floating pulley 74 is supported by cable 82 which passes over pulley 84 and is coupled to weight stack 90. Cable 82 is secured to top coupling weight 94 which may be selectively coupled to additional individual weights 92 of weight stack 90. Top coupling weight 94 and individual weights 92 are free to slide vertically along guide bars 96 which are supported between longitudinal base member 24 and top beam 30.

Although apparatus 10 employs weight stack 90 as a means for providing exercise resistance, it will be recognized that other conventional or unconventional resistance means could be employed as a matter of design choice, such as, for example, springs, pneumatic or hydraulic cylinders, electromagnets, etc.

Resistance to forward rotation of pectoral fly arms 40 is transmitted through cables 58 to lever arm 60 and thence through cable 66. Cable 66 is restrained at its respective ends by cable stop 69 at bracket 70 and by attachment to leg extension/curl arm 80. As lever arm 60 is pulled upwards by cables 58, cable 66 is tensioned, thereby exerting a downward force on floating pulley 74. As floating pulley 74 is pulled downward by continued operation of arms 40, a selected portion of weight stack 90 is lifted by cable 82.

When the pectoral fly station is not in use, lever arm 60 is supported by post 86 extending upwardly from lateral support member 26. When so supported, pulley 64 remains stationary so that either low pulley station 20 or leg extension/curl station 18 can utilize weight stack 90 through operation of cable 66.

It will be recognized that the arrangement of lever arm 60 and pulley 64 allows pectoral fly station 12 to be operated using cable 66 without the need to reconfigure any of the cables of apparatus 10 as required with the apparatus illustrated in U.S. Pat. No. 4,844,456. In fact, all of the cable operated stations of apparatus 10 remain ready for use at all times.

As mentioned above, leg extension/curl station 18 is operated by means of arm 80. Arm 80 is pivotally connected at 100 to support members 102 which are attached at 104 to the longitudinal base member 24. Inclined support member 106 is secured at opposite ends thereof to support members 102 and front upright member 34. Seat support bracket 108 is secured to inclined member 106 and telescopically receives seat support 110. Seat cushion 112 is fastened to seat support 110. The height of cushion 112 may be conveniently adjusted by means of detent release 114 and securing knob 116. Knee pads 118 extend from opposite sides of seat support 110 just forward of seat cushion 112. Similarly, ankle pads 120 extend from opposite sides of leg extension/curl arm 80. Back cushion 122 is coupled to front upright member 34 and is preferably adjustable for tilt angle as described in U.S. Pat. No. 4,844,456.

Lifting of leg extension/curl arm 80 exerts tension on cable 66. As noted above, lever arm 60 is restrained by post 86 so that movement of leg extension/curl arm 80 is transmitted through cable 66 to downward motion of floating pulley 74. As described in connection with operation of the pectoral fly station, such downward movement of floating pulley 74 causes a selected portion of weight stack 90 to be lifted by cable 82.

Press arm station 16 is operated by means of press arm 130 which is pivotally secured at 132 to top beam 30. Press arm 130 carries pulleys 134 and 136 through which cable 82 is threaded. Cable 82 is also threaded through pulleys 138 and 140 which are mounted to main upright member 32. Backward motion of press arm 130 is limited by post 142 which projects forwardly from the junction of main upright member 32 and front upright member 34.

Press arm station 16 shares seat cushion 112 and back cushion 122 with leg extension/curl station 18. Hand grips 144, 146 and 148 extend from press arm 130, providing the operator with a choice of grip locations and orientations.

Figure 5:
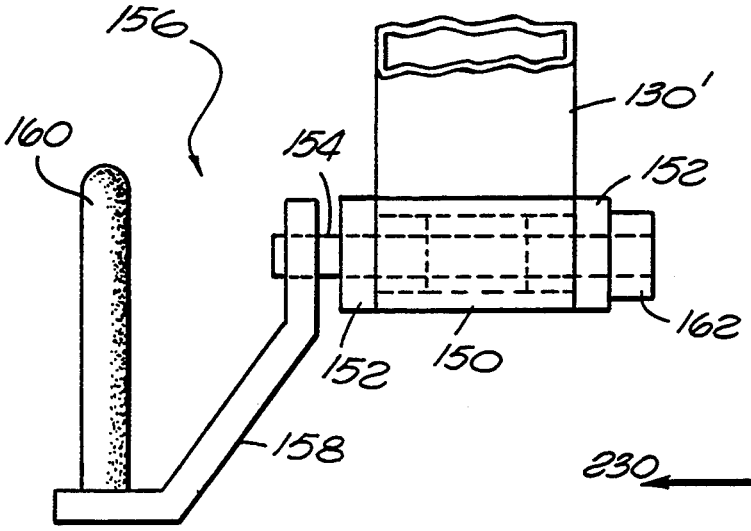
FIG. 5 is a detailed view of an alternative hand grip for the press arm of the described embodiment.

Referring to FIG. 5, an alternative to hand grips 146 and 148 is illustrated. In this variation, press arm 130 terminates with a short tubular member 150. Bearings 152 are inserted within tubular member 150 and receive shaft 154 of hand grip assembly 156. Hand grip 160 is secured to angle bracket 158, which in turn is secured to shaft 154. Shaft 154 is retained in bearings 152 by retaining collar 162. Grip assembly 156 thus freely pivots at the end of press arm 130' to provide the operator with a continuously variable hand grip orientation.

Referring again to FIGS. 1–3, forward movement of press arm 130 by an operator exerts a pull on cable 82, thereby lifting a selected portion of weight stack 90. It is to be understood that floating pulley 74 is restrained in its vertical position by cable 66 which is stopped at its respective ends by pulley 70 and leg extension/curl arm 80.

At station 14, lat bar 170 operates on cable 82 over high pulley 172. When lat bar 170 is in use, tension in cable 82 causes press arm 130 to be forced against post 142. Downward motion of lat bar 170 thus translates directly to an upward pull on a selected portion of weight stack 90. Brackets 174 are provided on top beam 30 to retain lat bar 170 when not in use. A cable stop 69 is secured to cable 82 adjacent to the coupling point for lat bar 170 to provide a positive stop at top beam 30 even in the event that lat bar 170 is removed from cable 82.

Unlike the previously described exercise stations, vertical knee raise station 22 does not employ weight stack 90. Arms 180 are rigidly secured to rear upright member 28. Cushions 182 and hand grips 184 are attached to arms 180. Back support 186 is rigidly secured to rear upright member 28, but may be made adjustable for height. Step 188 is also secured to rear upright member 28. Hand grips 190 are also provided on arms 180 for performing tricep dips.

Figure 3:
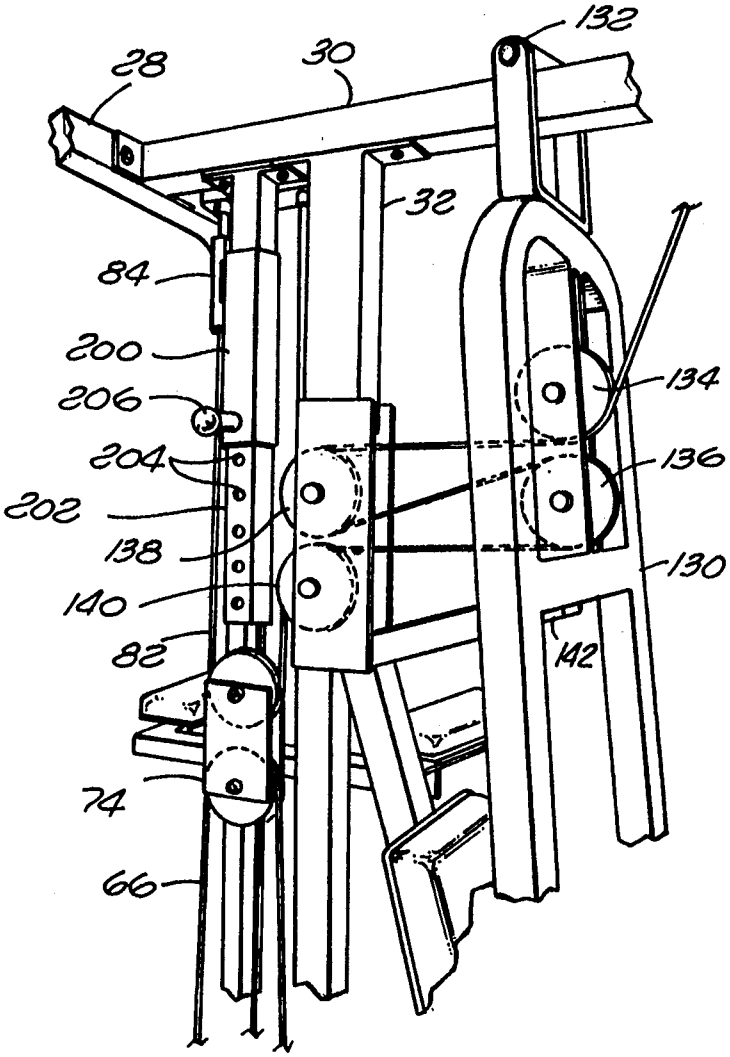
FIG. 3 is a detailed perspective view of a portion of the cable and pulley system of the described embodiment.

Referring particularly to FIG. 3, pulley 84 is preferably attached to an adjustable member 200 with which the position where resistance is first encountered for the various operative members of the exercise stations may be adjusted. Such an adjustment mechanism is fully described in this inventor's co-pending application Ser. No. 07/401,010, filed on Aug. 30, 1989 the disclosure of which is incorporated herein by reference. Adjustment member 200 slidably engages guide bar 202 which extends downward from top beam 30. Guide bar 202 is provided with a plurality of adjustment holes 204. Spring loaded detent or stop pin 206 is provided on adjustment member 200 and may be selectively engaged in any of holes 204 so as to adjust the vertical height of pulley 84.

Figure 6:
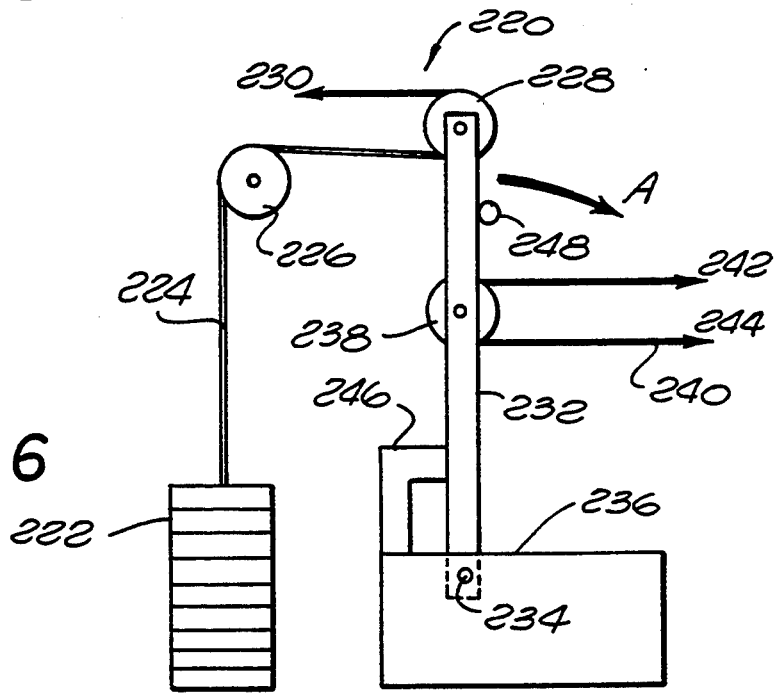
FIGS. 6 and 7 diagrammatically illustrate a multiple lever arm exercise apparatus according to the present invention.

Recall that lever arm 60 is provided to facilitate operation of pectoral fly station 12 without the need to reconfigure the cable arrangement of apparatus 10. Referring now to FIG. 6, an extension of the lever arm concept embodied in apparatus 10 is illustrated. FIG. 6 diagrammatically illustrates an apparatus 220 having a weight stack 222. A cable 224 is secured to a top coupling weight in weight stack 222 as in the above described apparatus 10. Cable 224 passes over pulleys 226 and 228 and is acted upon at one or more exercise stations designated generally as 230.

Pulley 228 is attached to an end of lever arm 232 which is pivotally attached at opposite end 234 to frame member 236. Lever arm 232 carries pulley 238 around which cable 240 is routed. Cable 240 communicates with pulling points 242 and 244, each of which may be additional exercise stations of the types previously described in connection with apparatus 10. It is to be understood that each pulling point or exercise station is equipped with stop means, such as cable stops 69 of apparatus 10, for retaining the cable end when such pulling point or exercise station is not in use. Thus, if either of pulling points 242 or 244 are operative, lever arm 232 will be pulled in the direction of arrow A. Cable 224 being restrained at 230 will result in the lifting of a selected portion of weight stack 222 by the pulling of cable 240 at either 242 or 244. Likewise, if both 242 and 244 are not operative, pulling of cable 224 at 230 will directly cause a selected portion of weight stack 222 to be lifted. A stop 246 may be conveniently secured to frame member 236 to limit backward travel of lever arm 232 independent of the restraint afforded by cable 240.

Figure 7:
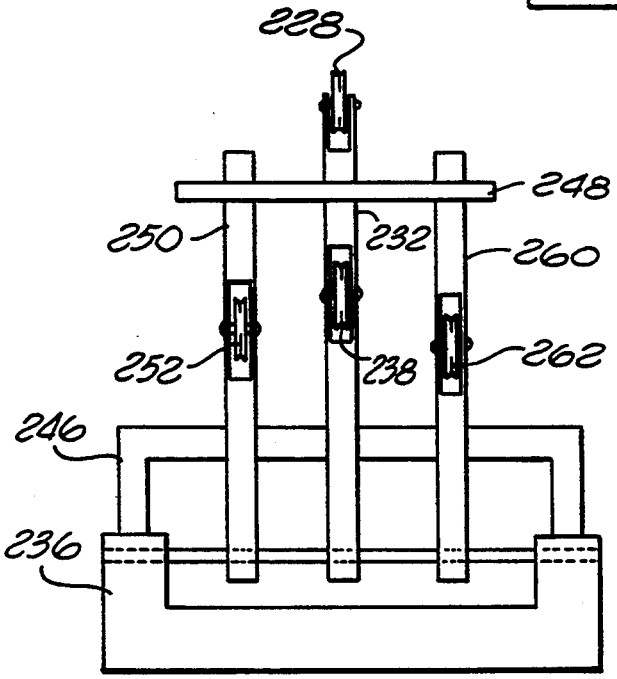

FIG. 7 is a diagrammatic illustration at right angles to the illustration of FIG. 6 showing lever arm 232 in combination with additional lever arms 250 and 260. Lever arms 250 and 260 are pivotally mounted to frame member 236 as is arm 232. Lever arms 250 and 260 carry pulleys 252 and 262 respectively. Each of these pulleys may carry a cable coupled to a pair of pulling points or exercise stations in the same manner as cable 240 carried by pulley 238. Bar 248 is attached to lever arm 232 and extends on either side thereof in front of lever arms 250 and 260. It will be observed that a pull exerted on either of lever arms 250 or 260 through respective cables guided by pulleys 252 and 262 will be communicated to lever arm 232 by bar 248. Thus, a pull on any one of the lever arms will cause a selected portion of weight stack 222 to be lifted. In this manner, a virtually unlimited number of pulling points may be coupled to a common weight stack so that a large number of exercise stations may be provided without multiplying the quantity of weights required. While each of lever arms 232, 250 and 260 is shown equipped with a pulley, thereby accommodating at least two pulling points or exercise stations, it is to be understood that a cable may be attached directly to any one or more of the lever arms as is the case with lever arm 60 of apparatus 10. Conversely, of course, lever arm 60 could be equipped with a pulley at end 61 to multiply the number of pulling points on apparatus 10.

The apparatus illustrated in FIGS. 6 and 7 is a marked improvement over prior art multistation exercise machines which require either a complex cable and pulley arrangement to achieve a large number of independent exercise stations or reconfiguration of the cable arrangement when changing exercise stations. A further advantage realized with the arrangement illustrated in FIGS. 6 and 7 resides in the fact that pulleys 238, 252 and 262 may be located at various positions on their respective lever arms with respect to the pivot point, thereby affecting the proportion of resistance communicated from weight stack 222. It can be seen that the lower the pulley is mounted on the lever arm, the greater will be the multiplying effect of the weight. Furthermore, multiple pulleys can be mounted on each of the lever arms to further increase the number of pulling points available. In addition, the resistance communicated through a lever arm will vary through the arc of the arm as the angle between the arm and the direction of pull changes. Thus, by judicious placement of the pulleys and/or pulling points in relation to each other and to the pivot point of the arm, the correspondence between a selected weight and the actual resistance experienced can be precisely controlled.

Yet a further advantage of the lever arm arrangement illustrated in FIGS. 6 and 7 is that separate cables may be provided for the various exercise stations instead of a continuous loop of cables and pulleys as in many prior art multistation machines. This limits the length of cable that must be tensioned to perform a particular exercise and thereby reduces the amount of cable stretch associated with certain exercise stations. In certain prior art machines with particularly complex cable and pulley systems, cable stretch can become a significant factor when performing some exercises. This effect is, of course, amplified when higher resistance values are used.

It will be recognized that the above described invention may be embodied in other specific forms without departing from the spirit or essential characteristics of the disclosure. Thus it is understood that the invention is not to be limited by the foregoing illustrative examples except as set forth in the appended claims.

I claim:

1. An exercise device for use by an operator comprising:

a frame;

first and second lever arms pivotally coupled to the frame on a common axis;

first and second exercise stations having first and second operable members moveable by the operator for performing respective exercises;

means for coupling respective ones of the operable members to corresponding ones of the lever arms such that movement of one of the operable members by the operator is translated into movement of the corresponding lever arm;

resistance means coupled to the first lever arm for resisting movement of the first operable member by the operator;

means for coupling the first and second lever arms for selective coordinated movement such that movement of the second lever arm as a result of operator movement of the second operable member causes movement of the first lever arm, thereby coupling the resistance means to tile second lever arm so as to resist movement of the second operable member by the operator, and further such that the second lever arm is decoupled from the first lever arm during movement of the first lever arm as a result of operator movement of the first operable member.

2. The apparatus of claim 1 wherein the means for coupling at least one of the operable members to its corresponding lever arm comprises a cable.

3. The apparatus of claim 2 further comprising stop means coupled to the cable at said at least one of the operable members for maintaining tension in the cable when any other operable member coupled to the cable is in use.

4. The apparatus of claim 1 wherein the means for coupling the operable members to the lever arms comprises a pulley disposed on one of the lever arms and a cable passing around the pulley coupled at respective ends of the cable to respective operable members.

5. The apparatus of claim 1 wherein the resistance means comprises a stack of weights.

6. The apparatus of claim 1 wherein the first and second lever arms are disposed in a side by side relationship and the means for coupling the first and second lever arms comprises a bar rigidly attached to the first lever arm and extending in front of the second lever arm.

7. The apparatus of claim 1 wherein the means for coupling the first and second lever arms comprises a rigid coupling member secured to the first lever arm for cooperative engagement with the second lever arm.

8. An exercise apparatus for use by an operator comprising:

a frame;

a lever arm pivotally coupled to said frame for pivotal movement about a first axis;

an exercise station disposed on said frame and having at least one operable member moveable by the operator, said operable member being pivotally moveable about a second axis different from said first axis;

means for coupling said operable member to said lever arm;

resistance means for resisting movement of said operable member by the operator; and resistance communication means coupled to said resistance means and said lever arm for coupling said resistance means to said operable member, said resistance communication means comprising a cable, a first pulley coupled to said frame and a second pulley coupled to said lever arm.

9. The apparatus of claim 8 wherein said exercise station is a first exercise station and further comprising a second exercise station also having at lest one operable member, said resistance communication means being further coupled to said operable member of said second exercise station.

10. The apparatus of claim 8 wherein said exercise station is a pectoral fly exercise station.

11. The apparatus of claim 10 further comprising a press arm exercise station having a press arm as an operable member, said resistance communication means being further coupled to said press arm.

12. The apparatus of claim 11 further comprising a leg extension/curl exercise station having a leg extension/curl arm as an operable member, said resistance means being further coupled to said leg extension/curl arm.

13. The apparatus of claim 10 further comprising a leg extension/curl exercise station having a leg extension/curl arm as an operable member, said resistance means being further coupled to said leg extension/curl arm.

14. The apparatus of claim 8 further comprising:

a second lever arm pivotally coupled to said frame for pivotal movement about said first axis;

a second exercise station disposed on said frame and having at least a second operable member moveable by the operator;

means for coupling said second operable member to said second lever arm; and means for coupling the first and second lever arms for selective coordinated movement such that movement of the second lever arm as a result of operator movement of the second operable member causes movement of the first lever arm, thereby coupling the resistance means to the second operable member.

15. An exercise apparatus for use by an operator comprising:

a frame;

a lever arm pivotally coupled to said frame;

an exercise station disposed on said frame and having at least one operable member moveable by the operator;

means for flexibly coupling said operable member to said lever arm;

resistance means for resisting movement of said operable member by the operator; and resistance communication means coupled to said resistance means and said lever arm for coupling said resistance means to said operable member, said resistance communication means comprising a cable, a first pulley coupled to said frame and a second pulley coupled to said lever arm.

16. The apparatus of claim 15 wherein said exercise station is a first exercise station and further comprising a second exercise station also having at lest one operable member, said resistance communication means being further coupled to said operable member of said second exercise station.

17. The apparatus of claim 15 wherein said exercise station is a pectoral fly exercise station.

18. The apparatus of claim 17 further comprising a press arm exercise station having a press arm as an operable member, said resistance communication means being further coupled to said press arm.

19. The apparatus of claim 18 further comprising a leg extension/curl exercise station having a leg extension/curl arm as an operable member, said resistance means being further coupled to said leg extension/curl arm.

20. The apparatus of claim 17 further comprising a leg extension/curl exercise station having a leg extension/curl arm as an operable member, said resistance means being further coupled to said leg extension/curl arm.

21. The apparatus of claim 15 further comprising:

a second lever arm pivotally coupled to said frame for pivotal movement about a common axis with the first lever arm;

a second exercise station disposed on said frame and having at least a second operable member moveable by the operator;

means for coupling said second operable member to said second lever arm; and means for coupling the first and second lever arms for selective coordinated movement such that movement of the second lever arm as a result of operator movement of the second operable member causes movement of the first lever arm, thereby coupling the resistance means to the second operable member.

* * * * *

UNITED STATES PATENT AND TRADEMARK OFFICE

CERTIFICATE OF CORRECTION

PATENT NO. : 5,417,633

DATED : MAY 23, 1995

INVENTOR(S) : Habing

It is certified that error appears in the above-identified patent and that said Letters Patent is hereby corrected as shown below:

In Claim 1 in column 7 at line 45 delete "means to tile second" insert --means to the second--.

Signed and Sealed this

Twelfth Day of December, 1995

*Attest:*

*Attesting Officer*

Bruce Lehman

BRUCE LEHMAN

*Commissioner of Patents and Trademarks*